US005161991A

United States Patent [19]

Bauer

[11] Patent Number: 5,161,991

[45] Date of Patent: Nov. 10, 1992

[54] ELECTROSTATIC DISCHARGE PLATE FOR AN ELECTRICAL CONNECTOR

[75] Inventor: Robert M. Bauer, Shirley, Mass.

[73] Assignee: Sun Microsystems, Inc., Mountain View, Calif.

[21] Appl. No.: 739,137

[22] Filed: Jul. 31, 1991

[51] Int. Cl.[5] ..... H01R 13/53

[52] U.S. Cl. ..... 439/181; 439/108

[58] Field of Search ..... 439/108, 181, 182, 183, 439/97

[56] References Cited

U.S. PATENT DOCUMENTS

| | | | |
|---|---|---|---|
| 3,502,933 | 3/1970 | Leimontas et al. | 439/182 |
| 3,958,854 | 5/1976 | Arrington et al. | 439/182 |
| 4,568,133 | 2/1986 | Amano et al. | 439/181 |
| 4,711,506 | 12/1987 | Tanaka | 439/181 |
| 4,729,752 | 3/1988 | Dawson, Jr. et al. | 439/620 |
| 4,828,506 | 5/1989 | Tuckwood | 439/181 |
| 5,002,495 | 3/1991 | Tanaka | 439/108 |
| 5,066,240 | 11/1991 | Verdun | 439/181 |

*Primary Examiner*—Larry I. Schwartz
*Assistant Examiner*—Hien D. Vu
*Attorney, Agent, or Firm*—Blakely Sokoloff Taylor & Zafman

[57] ABSTRACT

A connector that has a housing which contains a plurality of electrical contacts. The housing has a first face adapted to allow the electrical contacts to be coupled with another mating connector. Each electrical contact has a tail that extends from a second face which is opposite from the first face of the connector. Attached to the second face of the housing is an electrically conductive plate that is spaced a predetermined distance from the tails of the contacts. The space is wide enough so that the contacts are not shorted to the plate, yet small enough so that the air gap will break down and the plate and contact will be electrically coupled, when a predetermined voltage exist between the two conductive members.

8 Claims, 1 Drawing Sheet

ELECTROSTATIC DISCHARGE PLATE FOR AN ELECTRICAL CONNECTOR

BACKGROUND OF THE INVENTION

1. Field of the Invention

The present invention relates to electrical connectors, that have electrostatic discharge protection.

2. Description of Related Art

Electrical connectors are typically used to couple circuit boards which have numerous electrical components. The components are particularly sensitive to high voltage spikes caused by electrostatic discharge (ESD). The most common source of ESD is human contact with the board. Many computer systems are constructed so that a connector of the board is exposed and accessible to a user, to allow the user to connect a peripheral device such as a printer. Occasionally, an electrostatic charge will be transmitted from the user to the connector, wherein the ESD can cause damage to the components.

There have been various attempts to dampen connectors, to prevent the power associated with ESD from flowing into and damaging the circuit board. One such connector is disclosed in U.S. Pat. No. 4,729,752 issued to Dawson, Jr. et al., which has a plurality of diodes connected to the electrical contacts of the connector. The diodes operate as surge protectors that drain any high voltage transmitted to the connector. The Dawson connector requires numerous parts, which increases both the complexity and cost of the device.

U.S. Pat. No. 5,002,495 issued to Tanaka, discloses a connector with a shield plate that prevents human contact with the individual electrical contacts of the connector. The Tanaka connector includes springs which bias the plate into a protective position. The springs add to the complexity of the device and are subject to mechanical failure. Additionally, the shield plate and springs require a larger engagement force than typical connectors, and the shield plate of the Tanaka design only protects one of the mating connectors, leaving the other half exposed to possible damage. It would therefore be desirable to have a connector with an ESD suppression device that is simple to use and assemble.

SUMMARY OF THE INVENTION

The present invention is a connector that has a housing which contains a plurality of electrical contacts. The housing has a first face adapted to allow the electrical contacts to be coupled with another mating connector. Each electrical contact has a tail that extends from a second face which is opposite from the first face of the connector. Attached to the second face of the housing is an electrically conductive plate that is spaced a predetermined distance from the tails of the contacts. The space is wide enough so that the contacts are not normally shorted to the plate, yet small enough so that the air gap will break down and the plate and contacts will be electrically coupled, when a predetermined voltage exist between the two conductive members. The plate is preferably grounded so that when an electrostatic discharge is applied to the contacts, the current associated with such discharge will flow to ground and not into the circuit board or other device that is attached to the connector.

The electrically conductive plate can be attached by a heat staking process or by simply bonding the plate to the housing. The bonding process allows the plate to be retrofitted onto existing connectors so that the modified connectors have ESD protection.

Therefore it is an object of this invention to provide a connector with an ESD suppression device that is easy to assemble and use.

It is also an object of this invention to provide an ESD suppression device that can be easily retrofitted onto existing connectors.

BRIEF DESCRIPTION OF THE DRAWINGS

The objects and advantages of the present invention will become more readily apparent to those skilled in the art after reviewing the following detailed description and accompanying drawings, wherein.

DETAILED DESCRIPTION

Figure 1:
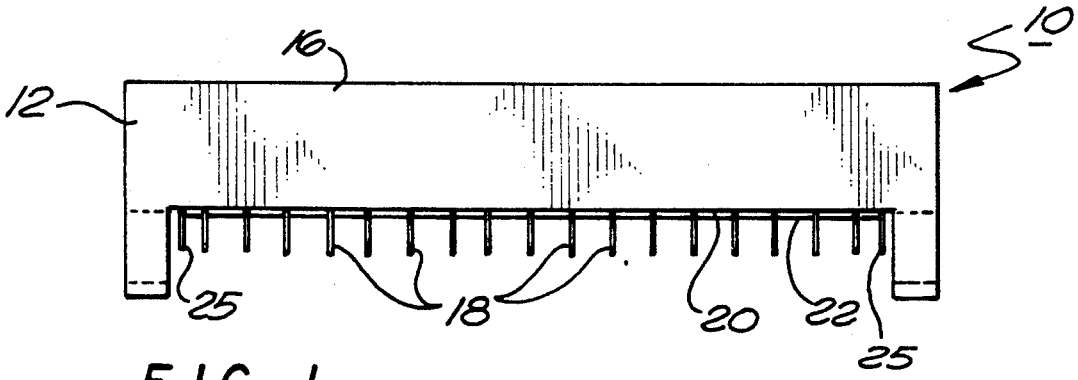
FIG. 1 is a side view of a connector of the present invention.
Figure 2:
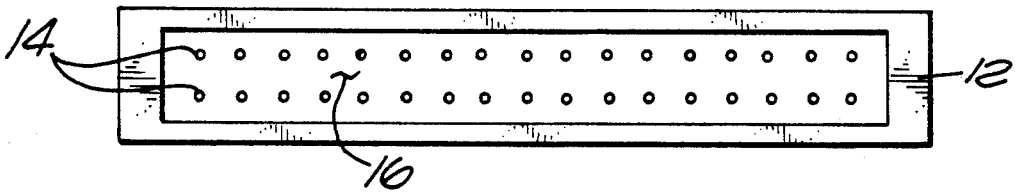
FIG. 2 is a top view of the connector of FIG. 1.
Figure 3A:
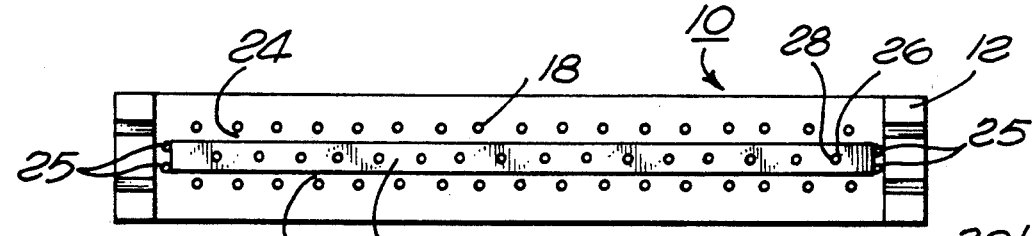
FIG. 3*a* is a bottom view of the connector of FIG. 1.

Referring to the drawings more particularly by reference numbers, FIGS. 1–3 show a connector 10 of the present invention. The connector 10 has a housing 12 constructed from a dielectric material. Within the housing 12 are a plurality of electrical contacts 14 The contacts 14 can be either pin/socket, card edge or any other type of contact typically used in electrical connectors. The contacts 14 and housing 12 are formed and assembled with methods known in the art. The housing 12 has a first face 16 that is constructed to allow a mating connector (not shown) to be coupled with the connector 10.

Each contact 14 has a tail 18 which extends from a second face 20 of the connector 10. The tails 18 provide a means for attaching the connector 10 to a circuit board or other electrical devices, as is well known in the art. Attached to the second face 20 of the housing 12 is an electrically conductive plate 22. There is an air gap 24 between the plate 22 and tails 18, that separates the two members so that contacts 14 and plate 22 are not normally electrically connected. The air gap 24 is of such a width that when a predetermined voltage exist between the plate 22 and any of the contacts 14, the dielectric characteristics of the air gap 24 will break down so that the current associated with such voltage will flow from the tails 18 to the plate 22. For example, with an air gap of approximately 0.020 inches, a voltage of approximately 1000–2000 volts will create a current flow from the contacts 14 to the plate 22. It being understood that such numbers are being used for illustrative purposes and that the break down voltage for such an air gap 24 may vary according to other conditions, such as the humidity of the surrounding air.

Figure 3B:
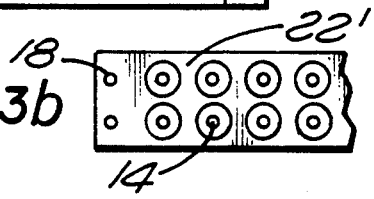
FIG. 3*b* is an enlarged view showing an ESD suppression plate attached to a pair of grounded contacts.

In the preferred embodiment, the plate 22 has a pair of plate tails 25 on each end, that are connected to an electrical ground (not shown). The plate tails 25 can be soldered to the same circuit board or wire harness that the tails 18 are attached to. Any voltage surge or spike applied to the contacts 14, is drained to ground through the plate 22 and plate tails 25. FIG. 3*b* shows an alternate embodiment of the connector wherein the plate 22' is directly attached to contacts 14 that are at ground potential, thereby grounding the plate 22'. When a voltage that exceeds the break down limit of the air gap exist on any of the pins 14, the current associated with such voltage will flow to the plate 22 and ground, instead of into the board or device that is attached to the tails 18. The break down voltage of the air gap 24 should be preferably less than the maximum voltage that can be tolerated by the device coupled to the connector 10, so that the plate 22 will drain the excessive power before the device is damaged. The plate 22 can therefore protect a circuit board or other device attached to the connector 10, from any voltage spikes that are transmitted to the contacts 14. This is particularly useful for absorbing any ESD that builds up or is applied to the connector 10. Thus when a person touches one of the pins 14 and creates a electrostatic discharge above the break down voltage, the plate 22 absorbs the power and protects the circuit board from possible damage.

The plate 22 can be attached to the housing by heat staking methods known in the art, wherein a plurality of extrusions 26 extend through a plurality of holes 28 in the plate 22. The extrusions 26 are larger than the holes 28 so that the plate 22 cannot be removed from the housing 12. The plate 22 is preferably constructed from brass, which is electrically conductive and stiff enough to be easily attached to the housing 12. The brass is preferably tin plated to environmentally protect the plate 22. Although a heat staking method is described, any other method of attaching the plate 22 to the housing 12 can be employed, including bonding the plate 22 with an adhesive. The bonding process allows the plate 22 to be retrofitted onto preexisting connectors which do not have adequate ESD protection.

Figure 4:
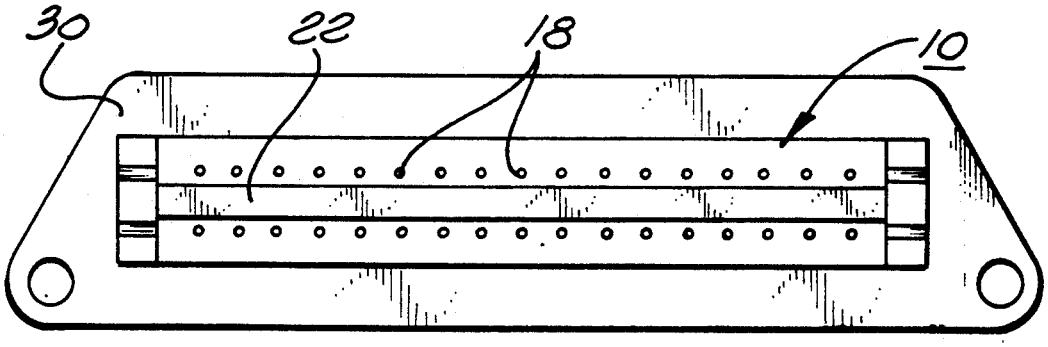
FIG. 4 is a bottom view of an alternate embodiment of the connector of FIG. 1, wherein the ESD suppression device is connected to a metal housing of the connector.

As shown in FIG. 4, the housing 12 may have a metal shell 30 that protects the dielectric material as is well known in the art. The shell 30 can be at ground potential, wherein the plate 22 is grounded by attaching the plate 22 to the shell 30. Although a connector 10 with a plate 22 extending between two parallel rows of tails 18 is shown, it is to be understood that the plate 22 can be used with staggered rows of contacts 14, wherein the plate 22 would have a plurality of holes that would allow the tails 18 to extend therethrough. The holes would create the air gap 24 between the plate 22 and tails 18.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. An electrical connector, comprising:

a housing having a metal shell, a first face and a second opposite face;

at least one electrical contact attached to said housing, said electrical contact having a tail extending from said second face of said housing; and, an electrically conductive plate attached to said metal shell and having at least one hole that allows said contact tail to extend through said conductive plate, said conductive plate being spaced from said tail such that a current will flow between said electrical contact and said electrically conductive plate when a predetermined voltage exist between said electrical contact and said electrically conductive plate.

2. The connector as recited in claim 1, wherein said conductive plate has at least one plate tail extending from said conductive plate.

3. The connector as recited in claim 1, wherein there are a plurality of electrical contacts.

4. The connector as recited in claim 1, wherein one of said electrical contacts is at ground potential and said electrically conductive plate is connected to said electrical contact at ground potential.

5. The connector as recited in claim 1, wherein said electrically conductive plate is constructed from a tin plated brass.

6. The connector as recited in claim 1, wherein said electrically conductive plate is attached to said housing by a plurality of extrusions that extend through a plurality of holes within said electrically conductive plate.

7. An electrical connector, comprising:

a housing having a metal shell, a first face and a second opposite face;

a plurality of electrical contacts attached to said housing, said electrical contacts each having a tail extending from said second face of said housing; and, an electrically conductive plate attached to said metal shell, said electrically conductive plate being spaced from said tails such that a current will flow between at least one of said electrical contacts and said electrically conductive plate when a predetermined voltage exist between at least one of said electrical contacts and said electrically conductive plate.

8. The connector as recited in claim 6, wherein said electrically conductive plate is constructed from a tin plated brass.

* * * * *